US008025353B2

(12) United States Patent
Hasenbein

(10) Patent No.: US 8,025,353 B2
(45) Date of Patent: Sep. 27, 2011

(54) PROCESS AND APPARATUS TO PROVIDE VARIABLE DROP SIZE EJECTION WITH AN EMBEDDED WAVEFORM

(75) Inventor: Robert Hasenbein, Enfield, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 265 days.

(21) Appl. No.: 12/126,706

(22) Filed: May 23, 2008

(65) Prior Publication Data

US 2009/0289982 A1 Nov. 26, 2009

(51) Int. Cl.
*B41J 29/38* (2006.01)

(52) U.S. Cl. ..... 347/11; 347/9; 347/10; 347/15

(58) Field of Classification Search ..... None
See application file for complete search history.

(56) References Cited

U.S. PATENT DOCUMENTS

| | | | | |
|---|---|---|---|---|
| 6,290,315 | B1 | 9/2001 | Sayama | |
| 6,328,395 | B1 * | 12/2001 | Kitahara et al. | 347/9 |
| 6,378,972 | B1 | 4/2002 | Akiyama et al. | |
| 6,488,354 | B2 * | 12/2002 | Hosono | 347/23 |
| 6,755,511 | B1 * | 6/2004 | Moynihan et al. | 347/68 |
| 7,213,898 | B2 * | 5/2007 | Hara | 347/15 |
| 7,281,778 | B2 | 10/2007 | Hasenbein et al. | |
| 2005/0200640 | A1 * | 9/2005 | Hasenbein et al. | 347/11 |
| 2006/0012624 | A1 * | 1/2006 | Vanhooydonck | 347/15 |
| 2006/0164450 | A1 | 7/2006 | Hoisington et al. | |
| 2006/0181557 | A1 | 8/2006 | Hoisington et al. | |
| 2008/0074451 | A1 | 3/2008 | Hasenbein et al. | |
| 2008/0170088 | A1 | 7/2008 | Letendre et al. | |

OTHER PUBLICATIONS

PCT International Search Report and Written Opinion of the Int'l Searching Authority for PCT International Appln No. PCT/US2009/043619, mailed on Sep. 30, 2009.

"PCT International Preliminary Report on Patentability (IPRP)", Notification Concerning Transmittal of International Preliminary Report on Patentability (Chapter I of the Patent Cooperation Treaty for PCT/US2009/043619, mailed on Dec. 2, 2010, pp. 5 total.

* cited by examiner

*Primary Examiner* — Matthew Luu
*Assistant Examiner* — Justin Seo
(74) *Attorney, Agent, or Firm* — Blakely, Sokoloff, Taylor & Zafman LLP

(57) ABSTRACT

Described herein is a process and apparatus for driving a droplet ejection device with embedded multi-pulse waveforms. In one embodiment, the process includes generating a multi-pulse waveform that includes drive pulses in predetermined positions. Next, the process includes applying the drive pulses to the actuator and causing the droplet ejection device to eject a first droplet of a fluid. The process also includes applying a second multi-pulse waveform having at least one embedded pulse to the actuator and causing the droplet ejection device to eject a second droplet of the fluid. Each embedded pulse is embedded between predetermined positions of two drive pulses. In some embodiments, the first and second droplets have different droplet sizes and these droplets are ejected at substantially the same effective drop velocity.

25 Claims, 12 Drawing Sheets

PROCESS AND APPARATUS TO PROVIDE VARIABLE DROP SIZE EJECTION WITH AN EMBEDDED WAVEFORM

TECHNICAL FIELD

Embodiments of the present invention relate to droplet ejection, and more specifically to using an embedded waveform for variable drop size ejection.

BACKGROUND

Droplet ejection devices are used for a variety of purposes, most commonly for printing images on various media. They are often referred to as ink jets or ink jet printers. Drop-on-demand droplet ejection devices are used in many applications because of their flexibility and economy. Drop-on-demand devices eject one or more droplets in response to a specific signal, usually an electrical waveform, or waveform, that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which drops are ejected. Droplet ejection is controlled by pressurizing fluid in the fluid path with an actuator, which may be, for example, a piezoelectric deflector, a thermal bubble jet generator, or an electrostatically deflected element. A typical printhead has an array of fluid paths with corresponding nozzle openings and associated actuators, and droplet ejection from each nozzle opening can be independently controlled. In a drop-on-demand printhead, each actuator is fired to selectively eject a droplet at a specific target pixel location as the printhead and a substrate are moved relative to one another. Because drop-on-demand ejectors are often operated with either a moving target or a moving ejector, variations in droplet velocity lead to variations in position of drops on the media. These variations can degrade image quality in imaging applications and can degrade system performance in other applications. Variations in droplet volume and mass lead to variations in spot size in images, or degradation in performance in other applications.

BRIEF DESCRIPTION OF THE DRAWINGS

The present invention is illustrated by way of example, and not by way of limitation, in the figures of the accompanying drawings and in which.

DETAILED DESCRIPTION

Described herein is a process and apparatus for driving a droplet ejection device with multi-pulse waveforms. In one embodiment, for ejecting a droplet from each nozzle in a printhead, the process includes generating a multi-pulse waveform that includes drive pulses in predetermined positions in the waveform. Next, the process includes applying the drive pulses to the actuator and causing the droplet ejection device to eject a first droplet of a fluid. The process also includes applying another multi-pulse waveform that includes the drive pulses in the predetermined positions, a subset of the drive pulses in the predetermined positions, the drive pulses in the predetermined positions with at least one additional embedded pulse between two pulses that are different than those used to eject the first droplet, a subset of the drive pulses in the predetermined positions with at least one additional embedded pulse between two pulses that are in their predetermined positions, or at least one additional embedded pulse without any of the drive pulses in the predetermined positions. This multi-pulse waveform is applied to the actuator and causes the droplet ejection device to eject a second droplet of the fluid. In some embodiments, the first and second droplets have different droplet sizes but these droplets are ejected at substantially the same effective drop velocity.

In another embodiment, the multi-pulse waveform includes three drive pulses fired during a time period to cause the droplet ejection device to eject an additional droplet of the fluid in response to the three drive pulses. Each ejected droplet discussed above can have a different droplet size with each droplet being ejected at substantially the same effective drop velocity.

Figure 1:
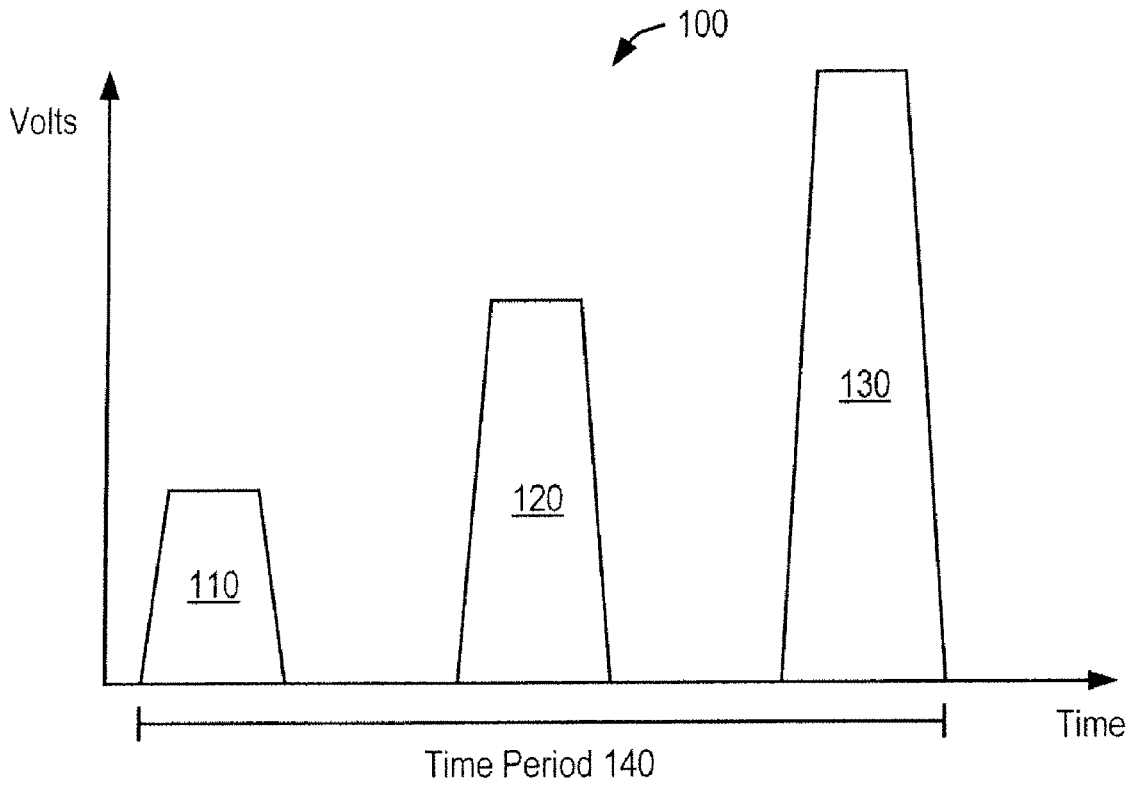
FIG. 1 illustrates a multi-pulse waveform with three pulses fired during a time period.

FIG. 1 illustrates a multi-pulse waveform with three pulses fired during a time period. The multi-pulse waveform 100 has three drive pulses 110, 120, and 130 fired during a time period 140 to cause the droplet ejection device to eject one or more droplets of the fluid in response to the drive pulses. Different portions of the multi-pulse waveform 100 can be independently applied to the actuator to produce three droplets having different droplet sizes. However, the three droplets are ejected at different effective drop velocities. Because drop-on-demand ejectors are often operated with either a moving target or a moving ejector, variations in droplet velocity lead to variations in position of drops on the media. These variations can degrade image quality in imaging applications and can degrade system performance in other applications. Variations in droplet volume and mass lead to variations in spot size in images, or degradation in performance in other applications.

Figure 2:
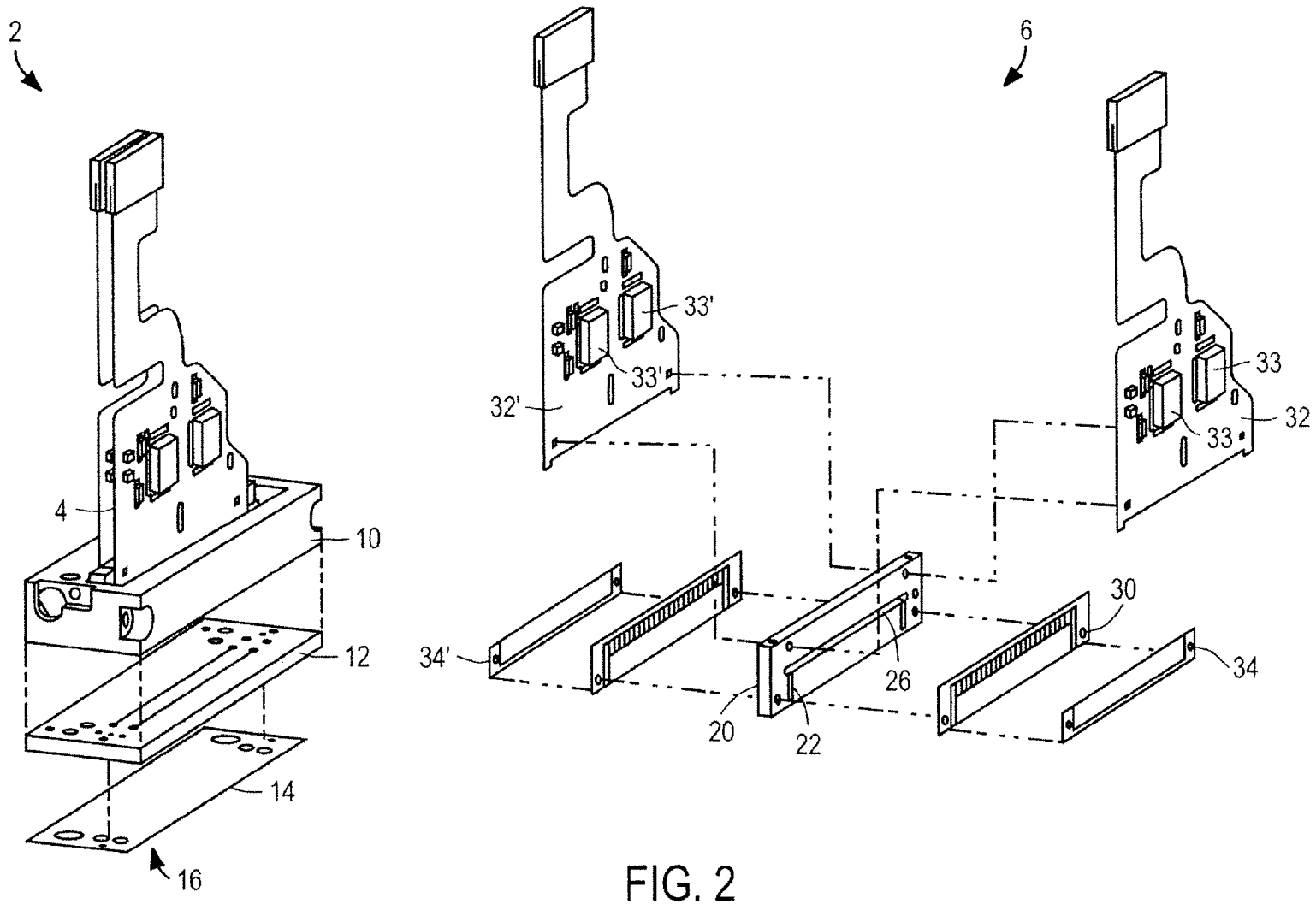
FIG. 2 is an exploded view of a shear mode piezoelectric ink jet print head in accordance with one embodiment.

FIG. 2 is an exploded view of a shear mode piezoelectric ink jet print head in accordance with one embodiment. Referring to FIG. 2, a piezoelectric ink jet head 2 includes multiple modules 4, 6 which are assembled into a collar element 10 to which is attached a manifold plate 12, and an orifice plate 14. The piezoelectric ink jet head 2 is one example of various types of print heads. Ink is introduced through the collar 10 to the jet modules which are actuated with multi-pulse waveforms to jet ink droplets of various droplet sizes (e.g., 30 nanograms, 50 nanograms, 80 nanograms) from the orifices 16 on the orifice plate 14 in accordance with one embodiment. Each of the ink jet modules 4, 6 includes a body 20, which is formed of a thin rectangular block of a material such as sintered carbon or ceramic. Into both sides of the body are machined a series of wells 22 which form ink pumping chambers. The ink is introduced through an ink fill passage 26 which is also machined into the body.

The opposing surfaces of the body are covered with flexible polymer films 30 and 30' that include a series of electrical contacts arranged to be positioned over the pumping chambers in the body. The electrical contacts are connected to leads, which, in turn, can be connected to flex prints 32 and 32' including driver integrated circuits 33 and 33'. The films 30 and 30' may be flex prints. Each flex print film is sealed to the body 20 by a thin layer of epoxy. The epoxy layer is thin enough to fill in the surface roughness of the jet body so as to provide a mechanical bond, but also thin enough so that only a small amount of epoxy is squeezed from the bond lines into the pumping chambers.

Each of the piezoelectric elements 34 and 34', which may be a single monolithic piezoelectric transducer (PZT) member, is positioned over the flex prints 30 and 30'. Each of the piezoelectric elements 34 and 34' have electrodes that are formed by chemically etching away conductive metal that has been vacuum vapor deposited onto the surface of the piezoelectric element. The electrodes on the piezoelectric element are at locations corresponding to the pumping chambers. The electrodes on the piezoelectric element electrically engage the corresponding contacts on the flex prints 30 and 30'. As a result, electrical contact is made to each of the piezoelectric elements on the side of the element in which actuation is effected. The piezoelectric elements are fixed to the flex prints by thin layers of epoxy.

Figure 3:
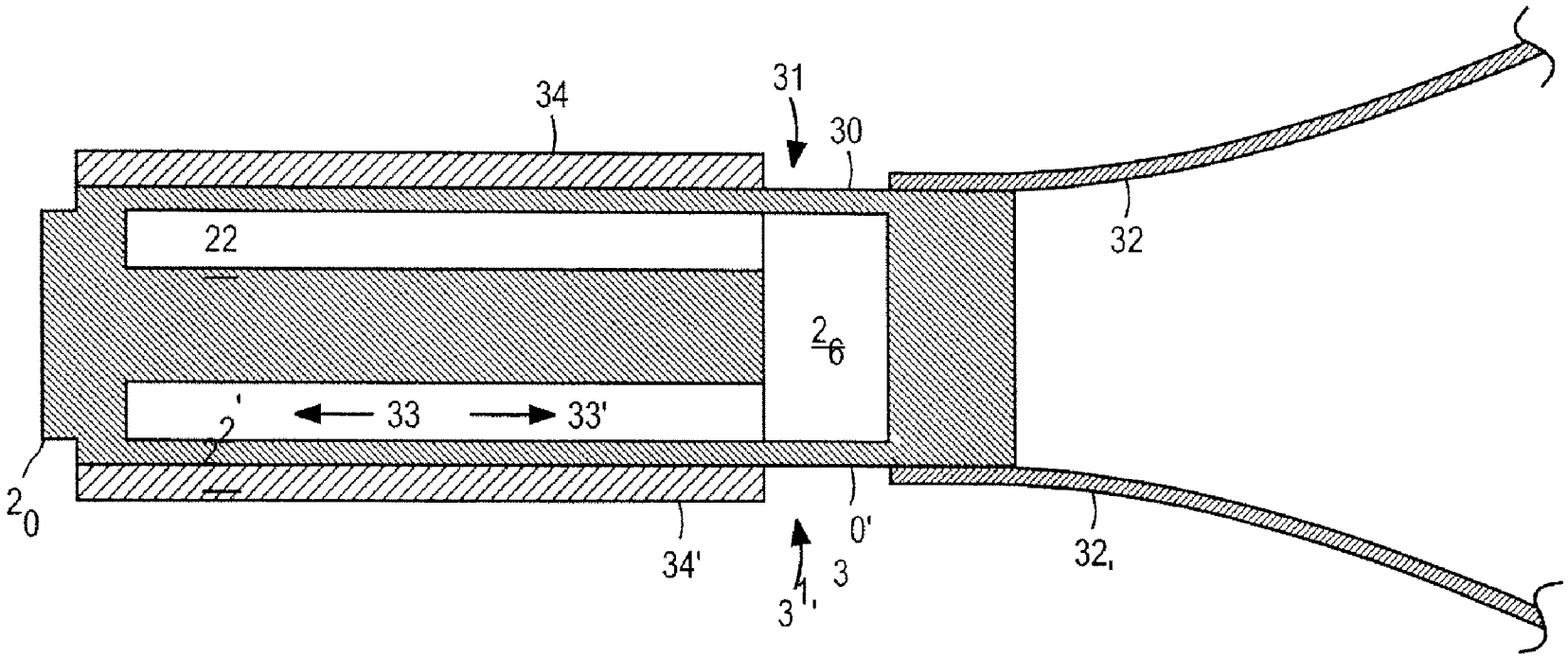
FIG. 3 is a cross-sectional side view through an ink jet module in accordance with one embodiment.

FIG. 3 is a cross-sectional side view through an ink jet module in accordance with one embodiment. Referring to FIG. 3, the piezoelectric elements 34 and 34' are sized to cover only the portion of the body that includes the machined ink pumping chambers 22. The portion of the body that includes the ink fill passage 26 is not covered by the piezoelectric element.

The ink fill passage 26 is sealed by a portion 31 and 31' of the flex print, which is attached to the exterior portion of the module body. The flex print forms a non-rigid cover over (and seals) the ink-fill passage and approximates a free surface of the fluid exposed to atmosphere.

Crosstalk is unwanted interaction between jets. The firing of one or more jets may adversely affect the performance of other jets by altering jet velocities or the drop volumes jetted. This can occur when unwanted energy is transmitted between jets.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave to be launched. This negative pressure starts in the pumping chamber and travels toward both ends of the pumping chamber (towards the orifice and towards the ink fill passage as suggested by arrows 33 and 33'). When the negative wave reaches the end of the pumping chamber and encounters the large area of the ink fill passage (which communicates with an approximated free surface), the negative wave is reflected back into the pumping chamber as a positive wave, traveling towards the orifice. The returning of the piezoelectric element to its original position also creates a positive wave. The timing of the deactuation of the piezoelectric element is such that its positive wave and the reflected positive wave are additive when they reach the orifice.

Figure 4:
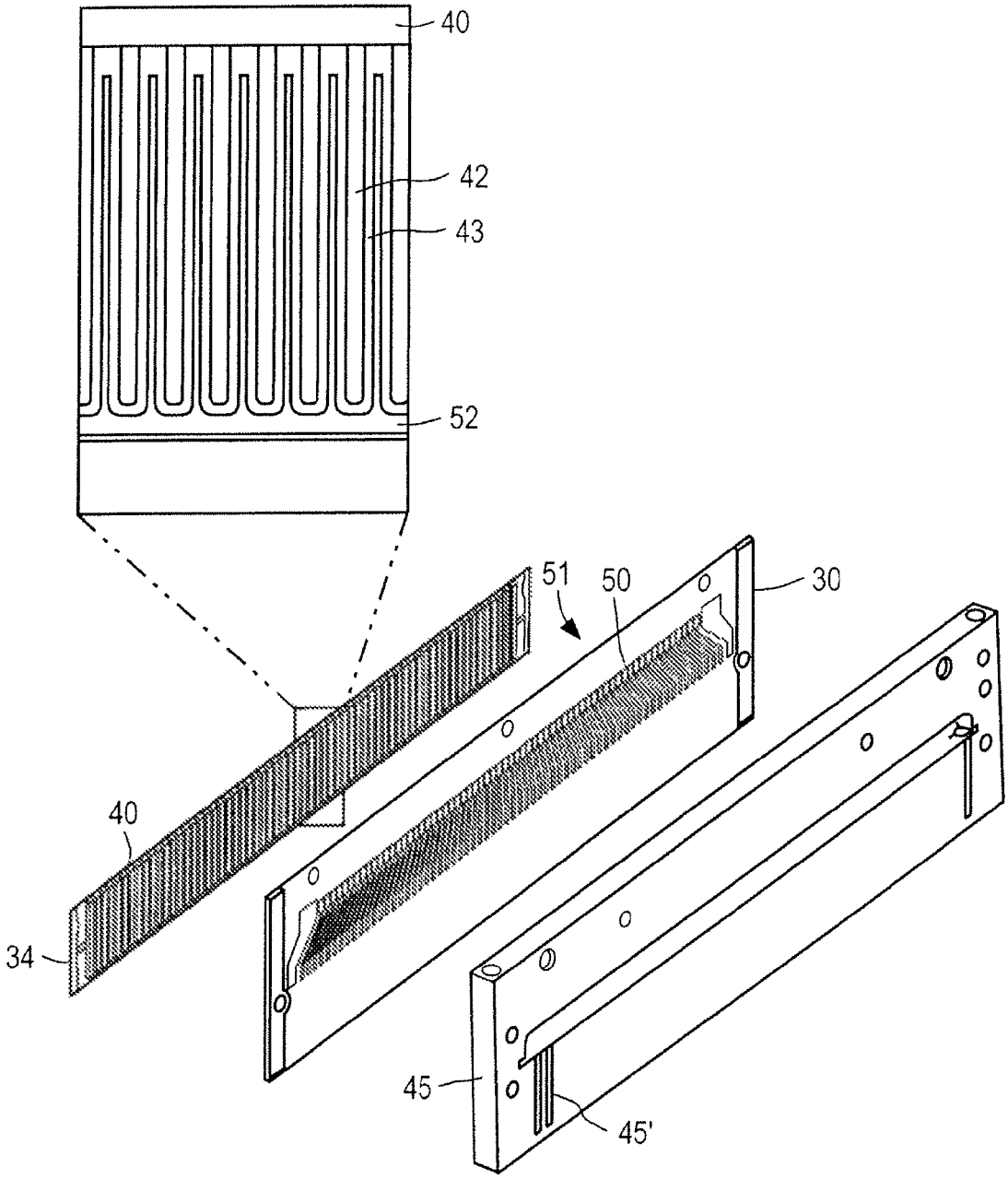
FIG. 4 is a perspective view of an ink jet module illustrating the location of electrodes relative to the pumping chamber and piezoelectric element in accordance with one embodiment.

FIG. 4 is a perspective view of an ink jet module illustrating the location of electrodes relative to the pumping chamber and piezoelectric element in accordance with one embodiment. Referring to FIG. 4, the electrode pattern 50 on the flex print 30 relative to the pumping chamber and piezoelectric element is illustrated. The piezoelectric element has electrodes 40 on the side of the piezoelectric element 34 that comes into contact with the flex print. Each electrode 40 is placed and sized to correspond to a pumping chamber 45 in the jet body. Each electrode 40 has an elongated region 42, having a length and width generally corresponding to that of the pumping chamber, but shorter and narrower such that a gap 43 exists between the perimeter of electrode 40 and the sides and end of the pumping chamber. These electrode regions 42, which are centered on the pumping chambers, are the drive electrodes. A comb-shaped second electrode 52 on the piezoelectric element generally corresponds to the area outside the pumping chamber. This electrode 52 is the common (ground) electrode.

The flex print has electrodes 50 on the side 51 of the flex print that comes into contact with the piezoelectric element. The flex print electrodes and the piezoelectric element electrodes overlap sufficiently for good electrical contact and easy alignment of the flex print and the piezoelectric element. The flex print electrodes extend beyond the piezoelectric element (in the vertical direction in FIG. 4) to allow for a soldered connection to the flex print 32 that contains the driving circuitry. It is not necessary to have two flex prints 30 and 32. A single flex print can be used.

Figure 5B:
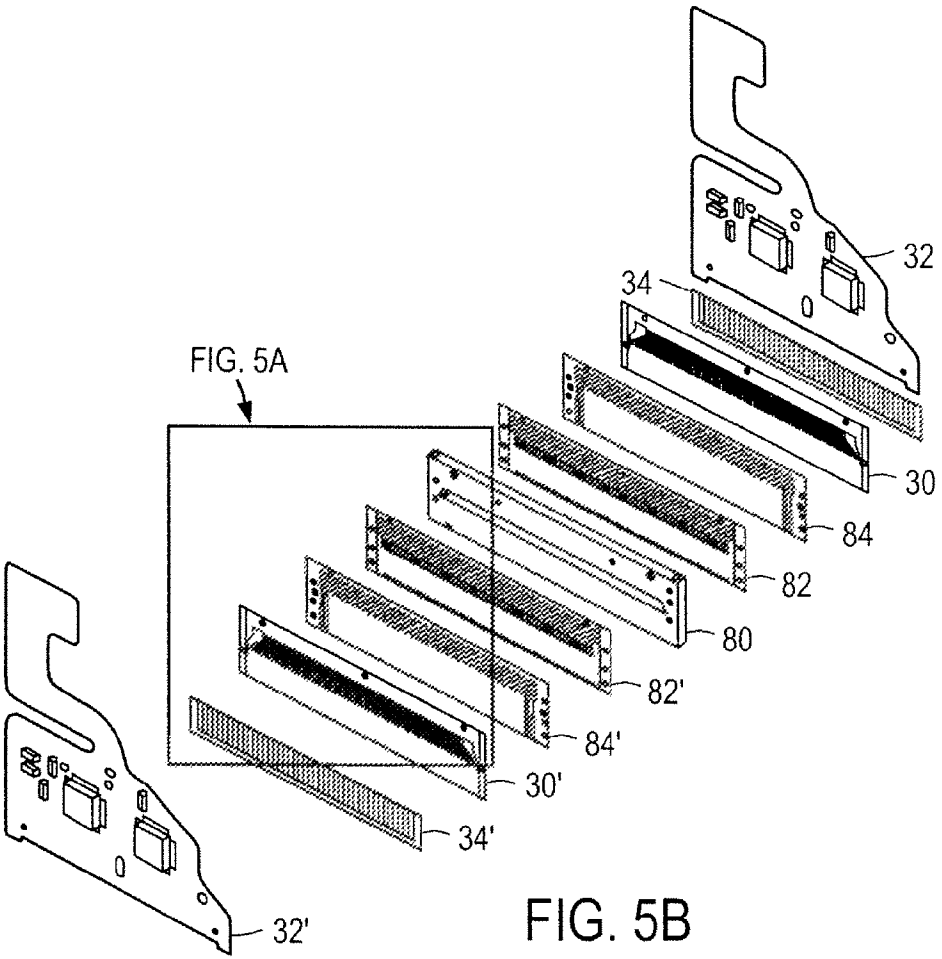
FIG. 5A is an exploded view of another embodiment of an ink jet module illustrated in FIG. 5B.
Figure 5A:
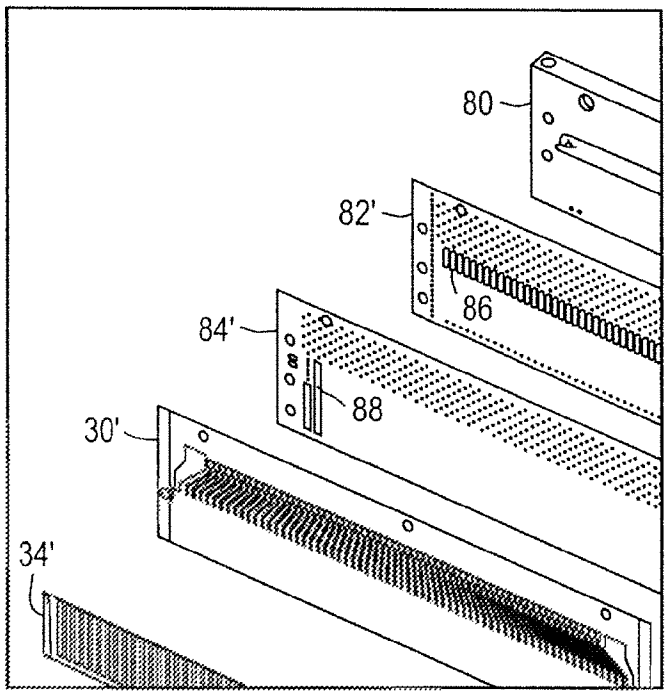

FIG. 5A is an exploded view of another embodiment of an ink jet module illustrated in FIG. 5B. In this embodiment, the jet body is comprised of multiple parts. The frame of the jet body 80 is sintered carbon and contains an ink fill passage. Attached to the jet body on each side are stiffening plates 82 and 82', which are thin metal plates designed to stiffen the assembly. Attached to the stiffening plates are cavity plates 84 and 84', which are thin metal plates into which pumping chambers have been chemically milled. Attached to the cavity plates are the flex prints 30 and 30', and to the flex prints are attached the piezoelectric elements 34 and 34'. All these elements are bonded together with epoxy. The flex prints that contain the drive circuitry 32 and 32', are attached by a soldering process.

Figure 6:
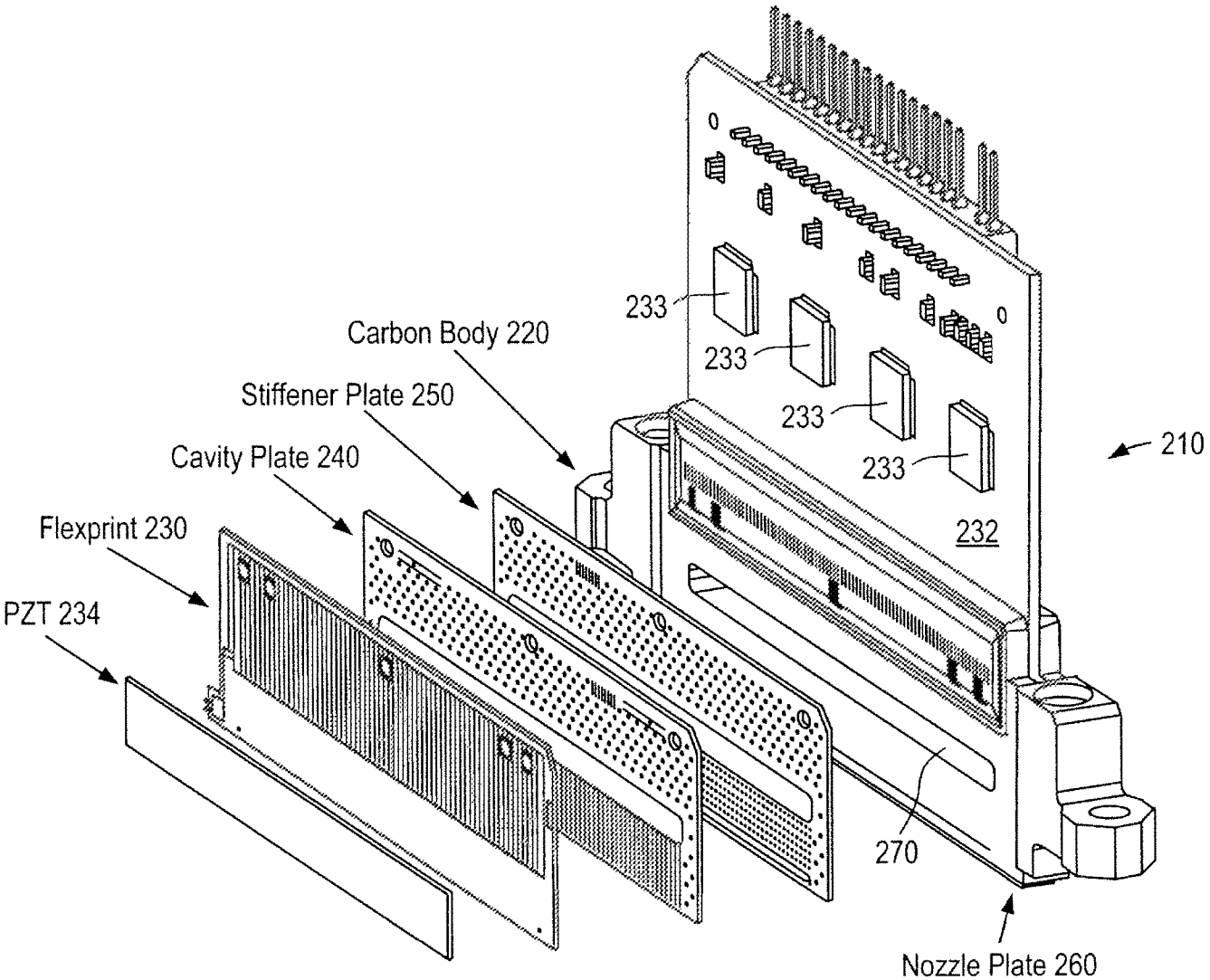
FIG. 6 is a shear mode piezoelectric ink jet print head in accordance with another embodiment.

FIG. 6 is a shear mode piezoelectric ink jet print head in accordance with another embodiment. The ink jet print head illustrated in FIG. 6 is similar to the print head illustrated in FIG. 2. However, the print head in FIG. 6 has a single ink jet module 210 in contrast to the dual ink jet modules 4 and 6 in FIG. 2. In some embodiments, the ink jet module 210 includes the following components: a carbon body 220, stiffener plate 250, cavity plate 240, flex print 230, PZT member 234, nozzle plate 260, ink fill passage 270, flex print 232, and drive electronic circuits 233. These components have similar functionality as those components described above in conjunction with FIGS. 2-5.

Figure 7:
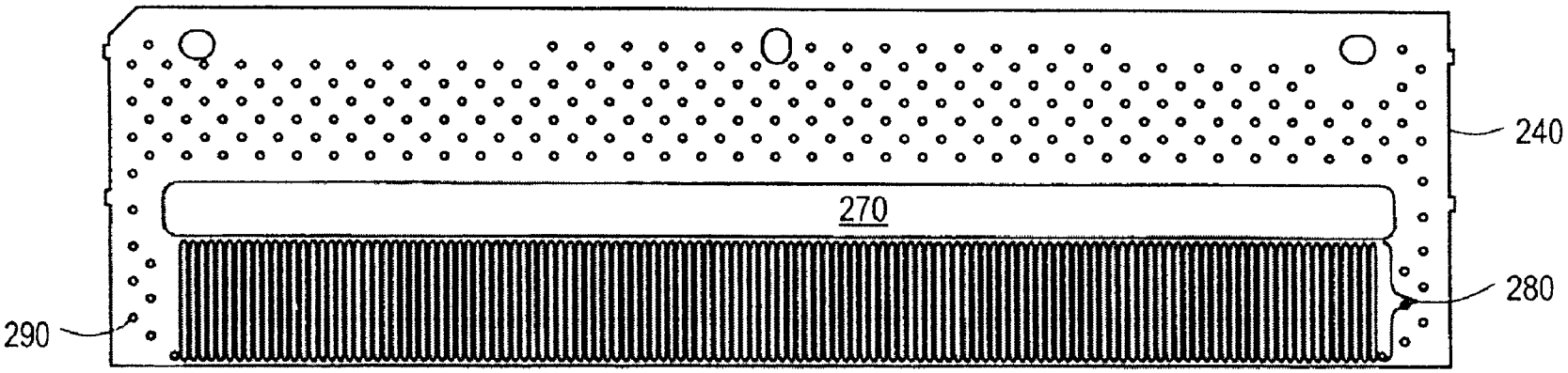
FIG. 7 is a perspective view of an ink jet module illustrating a cavity plate in accordance with one embodiment.

A cavity plate is illustrated in more detail in FIG. 7 in accordance with one embodiment. The cavity plate 240 includes holes 290, ink fill passage 270, and pumping chambers 280 that are distorted or actuated by the PZT 234. The ink jet module 210 which may be referred to as a droplet ejection device includes a pumping chamber as illustrated in FIGS. 6 and 7. The PZT member 234 (e.g., actuator) operates to vary the pressure of fluid in the pumping chambers in response to the drive pulses applied to the drive electronics 233.

In one embodiment, the PZT member 234 ejects one or more droplet sizes of a fluid from the pumping chambers. The drive electronics 233 are coupled to the PZT member 234. During operation of the ink jet module 210, the drive electronics 233 drive the PZT member 234 with a first multi-pulse waveform that includes drive pulses in predetermined positions to cause the PZT member 234 to eject a first droplet with a first droplet size of the fluid in response to the drive pulses of the multi-pulse waveform. The first multi-pulse waveform may include three drive pulses in their predetermined positions to cause the droplet ejection device to eject the first droplet of the fluid.

The drive electronics 233 also drive the PZT member 234 with a second multi-pulse waveform having different pulses than the first multi-pulse waveform, that includes at least two drive pulses, where such drive pulses including zero or more drive pulses of the drive pulses that are in predetermined positions and one or more additional pulses that are located in the second multi-pulse waveform at locations embedded between predetermined positions of two of the drive pulses, to cause the actuator to eject a second droplet of the fluid. Each of the ejected droplets can have a different droplet size and each droplet can be ejected at substantially the same effective drop velocity.

The second multi-pulse waveform may include one embedded drive pulse to cause the droplet ejection device to eject the second droplet of the fluid. The second multi-pulse waveform may also include two embedded drive pulses and no drive pulses in the predetermined locations to cause the droplet ejection device to eject the second droplet of the fluid. In one embodiment, a third waveform is applied to the actuator with the third waveform having one or more drive pulses fired to cause the droplet ejection device to eject a third droplet of the fluid with a third droplet size in response to applying the third waveform to the actuator.

Figure 8:
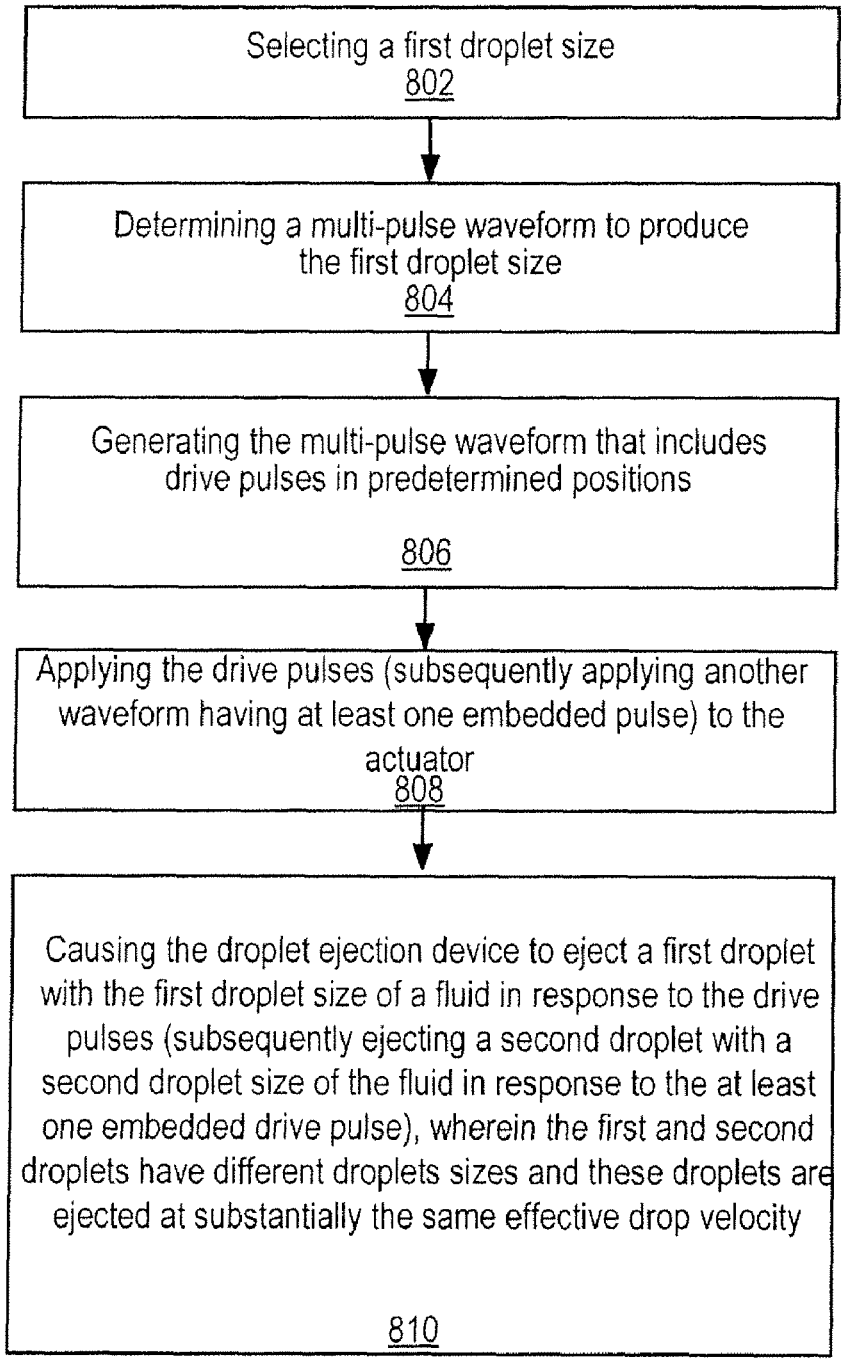
FIG. 8 illustrates a flow diagram of an embodiment of a process for driving a droplet ejection device with multi-pulse waveforms.

FIG. 8 illustrates a flow diagram of one embodiment of a process for driving a droplet ejection device with embedded multi-pulse waveforms in accordance with one embodiment. Referring to FIG. 8, the process for driving a droplet ejection device having an actuator includes selecting a first droplet size at processing block 802. Next, the process includes determining a multi-pulse waveform to produce a first droplet with the first droplet size at processing block 804. Next, the process includes generating the multi-pulse waveform that includes drive pulses in predetermined positions at processing block 806. Next, the process includes applying the multi-pulse waveform to the actuator at processing block 808 and causing the droplet ejection device to eject the first droplet of the fluid with the first droplet size in response to the multi-pulse waveform at processing block 810.

The process can repeat through the above processing blocks to apply another waveform to the actuator at processing block 808 and cause the droplet ejection device to eject a second droplet with a second droplet size of the fluid in response to this other multi-pulse waveform having different pulses than the first multi-pulse waveform, which includes at least two drive pulses that include zero or more drive pulses of the drive pulses that are in predetermined positions and one or more additional pulses that are located in the second multi-pulse waveform at locations embedded between predetermined positions of two of the drive pulses at processing block 810. In one embodiment, each embedded pulse is embedded in between the predetermined positions of two drive pulses. In some embodiments, the first and second droplets have different droplet sizes yet are ejected at substantially the same effective drop velocity. Additionally, a time period from initiation to termination of each multi-pulse waveform can be approximately the same even though each multi-pulse waveform may have different types and quantities of pulses in predetermined positions and/or embedded pulses.

In one embodiment, a first multi-pulse waveform can potentially have any combination of three drive pulses having predetermined locations in the waveform. In this embodiment, the drive pulses are fired to cause the droplet ejection device to eject a first droplet. A second multi-pulse waveform can include one or more embedded pulses, which are then fired to cause the droplet ejection device to eject a second droplet of the fluid in response to the embedded pulses. Each embedded pulse is embedded between predetermined positions of two drive pulses. A third waveform can include one or more drive pulses in predetermined positions or one or more embedded pulses that are then fired to cause the droplet ejection device to eject a third droplet of the fluid in response to the one or more drive pulses. The first, second, and third droplets each have different droplet sizes with each droplet having substantially the same effective drop velocity.

In some embodiments, the droplet ejection device ejects additional droplets of the fluid in response to the pulses of the multi-pulse waveform or in response to pulses of additional multi-pulse waveforms. A waveform may include a series of sections that are concatenated together. Each section may include a fixed time period (e.g., 1 to 3 microseconds) and a certain number of samples having a duration (e.g., 0.125 microseconds) and associated amount of data. The time period of a sample is long enough for control logic of the drive electronics to enable or disable each jet nozzle for the next waveform section. The waveform data is stored in a table as a series of address, voltage, and flag bit samples and can be accessed with software. A waveform provides the data necessary to produce a single sized droplet and various different sized droplets.

Figure 9:
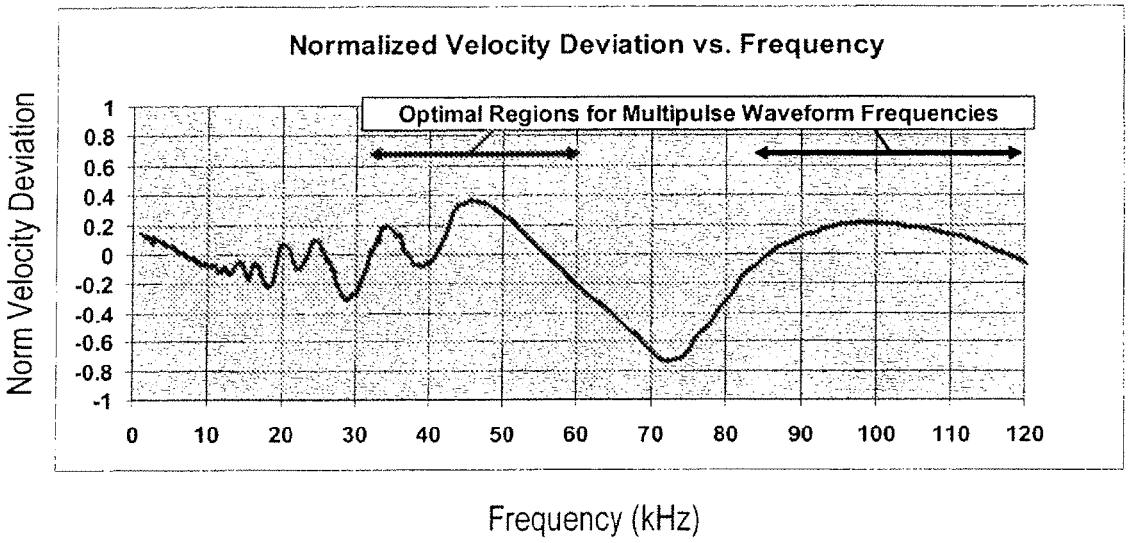
FIG. 9 illustrates a normalized velocity deviation versus frequency graph in accordance with one embodiment.

The spacing between the pulses of a multi-pulse waveform effectively define a frequency for the waveform, though the spacing is not necessarily constant. The effective pulse frequency can be calculated as follows:

$$\text{Frequency}=1/\text{Time},$$

where Time is the time between the pulses. FIG. 9 shows an example of a frequency response plot. This plot shows that there may be limitations to the pulse frequencies that will work effectively in a drop ejection device. The frequency response plot shows non-dimensional velocity deviation from a nominal value (e.g., 8 m/s) vs. firing frequency. Proper jetting, sustainability, and reasonable firing voltage are usually improved if the waveform frequency is such that the normalized frequency response is within a band of plus or minus about 0.2. In some jet configurations, the upper end of the frequency response can rise to or above the nominal value of zero velocity deviation. In such cases, the upper frequency limit for useful waveforms could be extended to include that upper frequency (e.g., above 100 kHz). The frequencies in the waveform, where the natural response of the jet is at a very low velocity, would be unlikely areas to design a waveform. For example, in the frequency range of about 60-85 kHz, the velocity is about 0.3 or more below the nominal velocity value.

Figure 10:
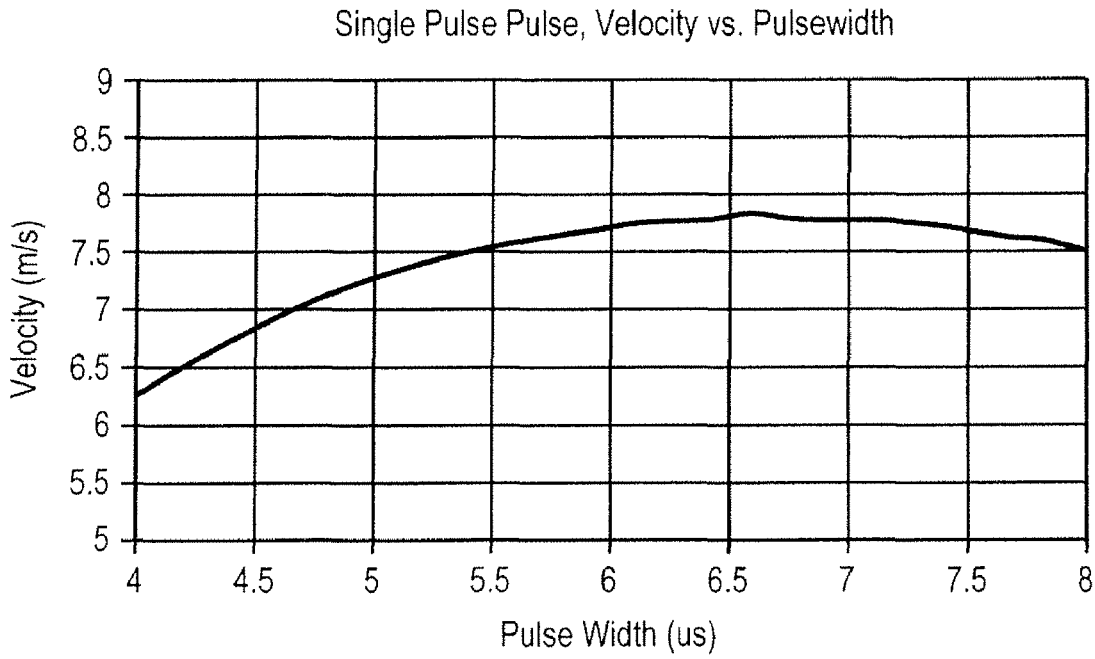
FIG. 10 illustrates a drop velocity versus pulse width graph for a single pulse in accordance with one embodiment.

The individual pulse widths, in each section of the waveform, may be determined separately from the pulse frequency. FIG. 10 shows an example of a plot of drop velocity versus pulse width. In general, the wider pulses also produce higher drop mass. The pulse width can be used in combination with the amplitude to adjust the mass and velocity of each sub-drop produced by the waveform. Extremely wide or narrow pulses may not usually be desirable because the velocity of the sub-drops becomes too low, and the voltages required to fire become excessive.

In view of the above restrictions, a waveform that produces several different drop sizes, has coalesced drops at each drop size, fires drops of each size at the same effective velocity, has good sustainability, and meets other requirements is described herein. Further, it is impractical to simply add extra pulses to the beginning or ending of a waveform because a wider waveform, when fired in a variable-drop-size mode, will not be able to fire to as high of a frequency in comparison to a waveform that does not have the extra pulses as illustrated in FIG. 1. For example, the waveform in FIG. 1 is 47 microseconds in duration and can operate up to approximately 20 khz for one embodiment.

Figure 11:
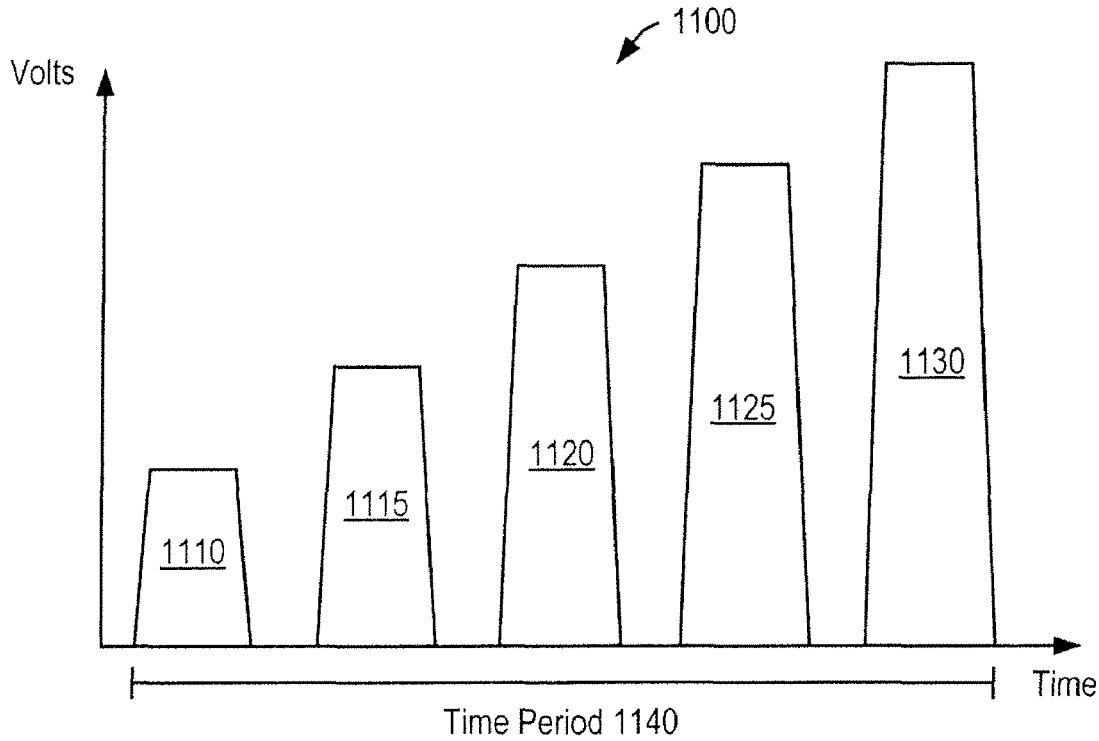
FIG. 11 illustrates a multi-pulse waveform with three pulses and two embedded pulses fired in accordance with one embodiment.

FIG. 11 illustrates a multi-pulse waveform with three pulses and two embedded pulses fired in accordance with one embodiment. The waveform 1100 shown in FIG. 11 has additional embedded pulses 1115 and 1125 embedded between the pulses 1110, 1120, and 1130 during a time period 1140. By contrast, the waveform 100 in FIG. 1 includes the pulses 110, 120, and 130 fired during the time period 140 with no embedded pulses. The time period 1140 and pulses 1110, 1120, and 1130 may be similar to the time period 140 and pulses 110, 120, and 130, respectively. In one embodiment, the voltages of the additional embedded pulses 1115 and 1125 are scaled or adjusted in comparison to the voltages of pulses 1120 and 1130, respectively, such that the droplet(s) produced by the embedded pulses 1115 and 1125 has a particular target velocity similar to the target velocity of the droplets produced by the pulses 1110, 1120, and 1130.

One resulting application of this waveform in FIG. 11 is to produce a first droplet (e.g., 30 ng drop) having a target velocity with pulse 1120. Pulses 1110, 1120, and 1130 firing in combination can produce a second droplet (e.g., 80 ng drop) with the same target velocity. Embedded pulses 1115 and 1125 can produce a third droplet (e.g., 50 ng drop) or any other mid-size drop with the same target velocity. The variable drop technology may be applied by switching on different parts of the waveform being fired as described above.

For various droplet sizes, the waveform 100 may not maintain the same effective drop velocity for each droplet size. For example, pulse 120 firing alone, can produce a first droplet size with an effective target velocity. Pulses 110, 120, and 130 firing together, may produce a second droplet size with a similar effective target velocity. Pulses 120 and 130, firing together, may produce a third droplet size with an effective velocity several meters per second faster than the other drops because the low velocity sub-drop from pulse 110 is not present to slow the velocity of the total drop.

However, the waveform 1100 is able to maintain the same effective drop velocity for each droplet size. For example, pulse 1120 firing alone, can produce a first droplet size (e.g., 30 ng) with an effective target velocity (e.g., 8 m/s). If the pulses 1120 and 1130 are fired at a reduced voltage and embedded in the waveform 1100, the combination of embedded pulses 1115 and 1125 produces a second droplet at the desired weight (e.g., 50 ng) at the target velocity (e.g., 8 m/s). In this case, the multi-pulse waveform 1100 has two additional embedded drive pulses fired during the same time period 1140 to cause the droplet ejection device to eject one additional droplet of the fluid in response to the two additional embedded drive pulses. Pulses 1110, 1120, and 1130 firing together, may produce a third droplet size (e.g., 80 ng) with a similar effective target velocity. The three droplets can have different droplet sizes with each droplet being ejected at substantially the same effective drop velocity during the time period 1140.

In one embodiment, the first droplet size is greater than the second droplet size which is greater than the third droplet size. In other embodiments, the first droplet size is less than the second droplet size which is less than the third droplet size. Also, the time period during which the pulses fire can be between forty and sixty microseconds in duration. In one embodiment, the effective drop velocity for each droplet is approximately 8 m/s with a range from 6 m/s to 11 m/s in order for different droplet sizes to land on a target with the same relative timing to that of the driving pulse or pulses that fire to eject each droplet.

For certain embodiments, other types of pulses, drop shaping sub-pulses, or completely different pulses can be embedded into the waveform of FIG. 11. Also, the waveform of FIG. 11 may include any number of pulses within a frequency range and these pulses can be embedded with additional pulses as described above.

Figure 12:
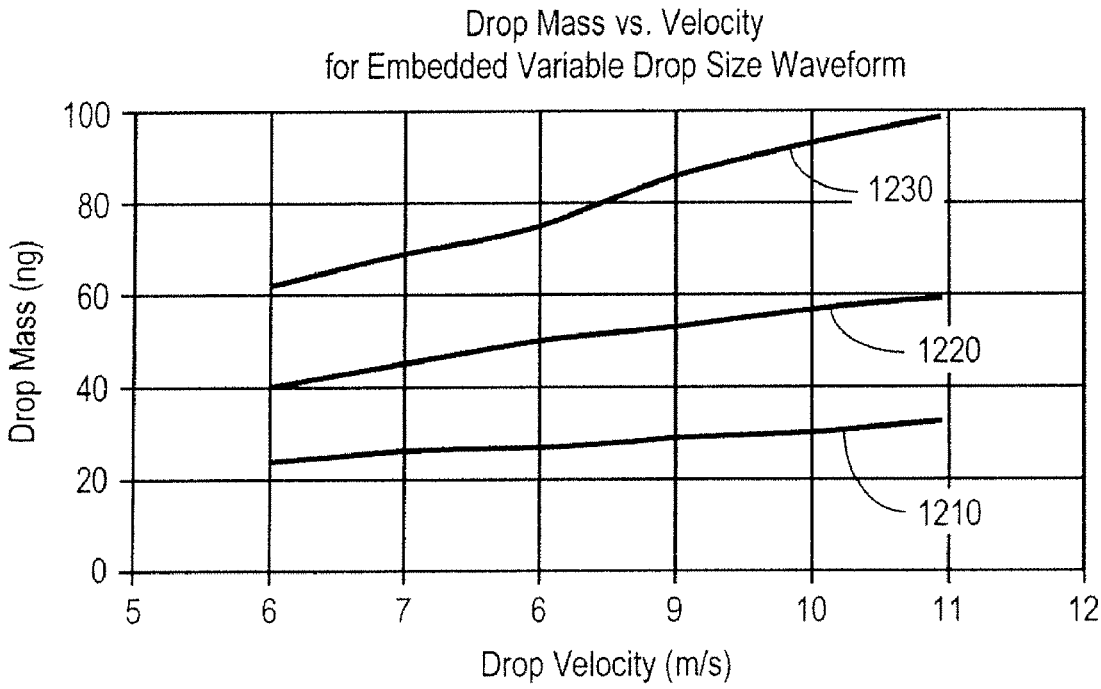
FIG. 12 is a graph illustrating drop mass versus drop velocity graph for an embedded variable drop size waveform in accordance with one embodiment.

FIG. 12 is a graph illustrating drop mass versus velocity for the waveform in FIG. 11 in accordance with one embodiment. The waveform voltage is constant for each operating condition. For example, the 8 m/s operating point produces a drop mass line 1210 that is slightly less than 30 ng if pulse 1130 fires alone. Pulses 1115 and 1125 firing in combination produce a drop mass line 1220 that is approximately 50 ng. Pulses 1110, 1120, and 1130 firing in combination produce a drop mass line 1230 that is approximately 75 ng.

Embedding portions of the waveform (e.g., pulse 1115 and 1125) within itself provides greater flexibility in the development of the waveform, permits improved drop formation for each drop size, and enables improved control over the drop velocities. Pre-pulses and post pulses applied to portions of a waveform can be used to improve drop formation, velocity frequency response, and mass frequency response. Other combinations of pulses 1110-1130 can be used to form other drop sizes and other drop velocities. For example, pulse 1115 or 1120 could be used to form a small drop having a particular drop velocity, and pulses 1115 and 1120 or 1120 and 1125 could be used to form a medium drop having the same drop velocity as the small drop, and pulses 1115, 1120, and 1125 or pulses 1115, 1120, and 1130 could be combined to form a large drop having a similar velocity as the small and medium drops.

Figure 13:
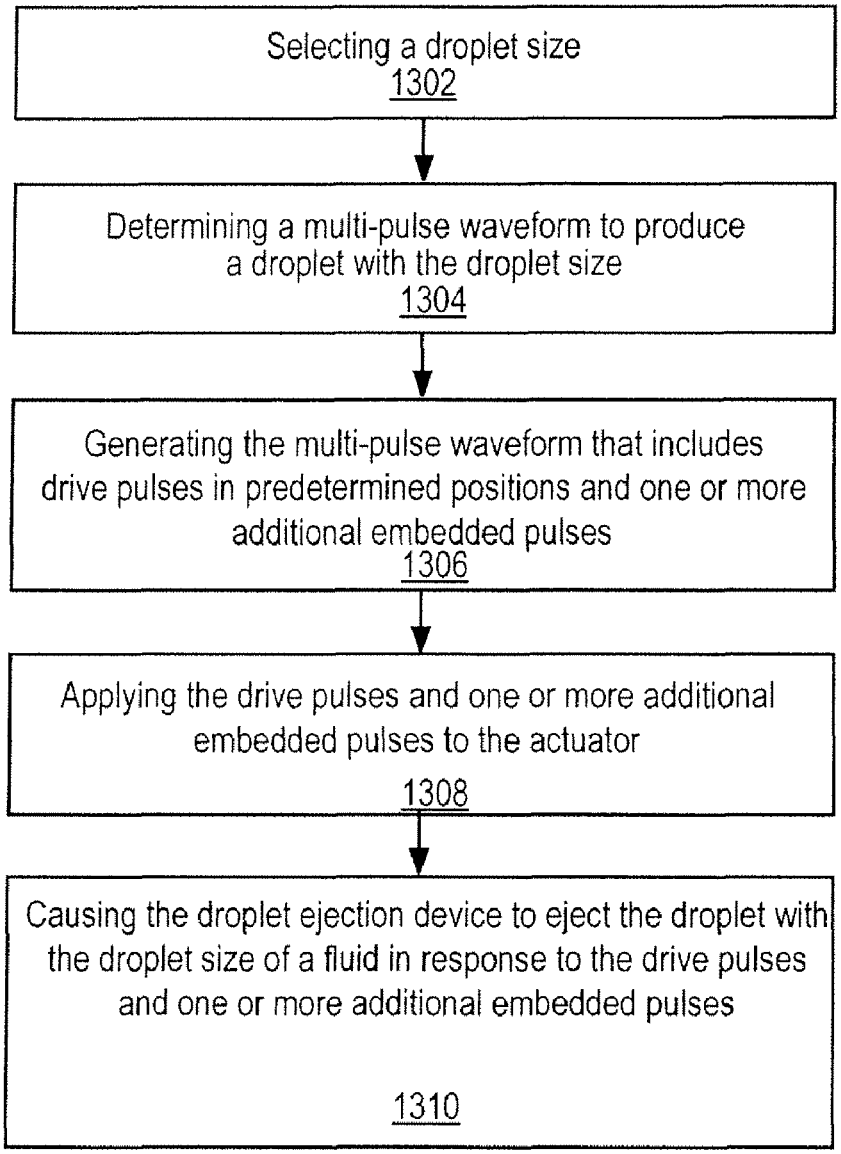
FIG. 13 illustrates a flow diagram of another embodiment of a process for driving a droplet ejection device with embedded multi-pulse waveforms in accordance with another embodiment.

FIG. 13 illustrates a flow diagram of another embodiment of a process for driving a droplet ejection device with embedded multi-pulse waveforms in accordance with another embodiment. Referring to FIG. 13, the process for driving a droplet ejection device having an actuator includes selecting one droplet size at processing block 1302. Next, the process includes determining a multi-pulse waveform to produce a droplet with the droplet size at processing block 1304. Next, the process includes generating the multi-pulse waveform that includes drive pulses in predetermined positions and one or more additional embedded pulses that are located in the multi-pulse waveform at locations embedded between predetermined positions of two of the drive pulses at processing block 1306. Next, the process includes applying the multi-pulse waveform to the actuator at processing block 1308 and causing the droplet ejection device to eject the droplet of the fluid with the droplet size in response to the multi-pulse waveform at processing block 1310.

The process can repeat through the above processing blocks to apply another waveform to the actuator at processing block 1308 and cause the droplet ejection device to eject a second droplet with a second droplet size of the fluid in response to this other multi-pulse waveform having different pulses than the first multi-pulse waveform, which includes at least two drive pulses that include zero or more drive pulses of the drive pulses that are in predetermined positions and zero or more additional pulses that are located in the second multi-pulse waveform at locations embedded between predetermined positions of two of the drive pulses at processing block 1310. In one embodiment, each embedded pulse is embedded in between the predetermined positions of two drive pulses. In some embodiments, the first and second droplets have different droplet sizes yet are ejected at substantially the same effective drop velocity.

In one embodiment, a first multi-pulse waveform can potentially have any combination of drive pulses and one or more additional embedded pulses in the waveform (e.g., pulses 1115, 1120, and 1125 or pulses 1115, 1120, and 1130). In this embodiment, the drive pulses are fired to cause the droplet ejection device to eject a first droplet. A second multi-pulse waveform can include zero or more drive pulses with predetermined positions and zero or more embedded pulses (e.g., pulses 1115 and 1120 or 1120 and 1125), which are then fired to cause the droplet ejection device to eject a second droplet of the fluid in response to the embedded pulses. Each embedded pulse is embedded between predetermined positions of two drive pulses. A third waveform can include one or more drive pulses in predetermined positions and/or one or more embedded pulses (e.g., pulse 1115 or 1120) that are then fired to cause the droplet ejection device to eject a third droplet of the fluid in response to the one or more drive pulses. The first, second, and third droplets each have different droplet sizes with each droplet having substantially the same effective drop velocity.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for driving a droplet ejection device having an actuator, comprising:

generating a first multi-pulse waveform that includes three or more drive pulses in predetermined positions and no drive pulses at locations embedded between the predetermined positions;

applying the three or more drive pulses of the first multi-pulse waveform to the actuator to cause the droplet ejection device to eject a first droplet with a first droplet size of a fluid;

generating a second multi-pulse waveform that includes no drive pulses in the predetermined positions and one or more drive pulses at locations embedded between the predetermined positions; and applying the one or more drive pulses of the second multi-pulse waveform to the actuator to cause the droplet ejection device to eject a second droplet with a second droplet size of the fluid, wherein the first and second droplets having different droplet sizes, these droplets are ejected at substantially the same effective drop velocity based on the peak voltages of the one or more drive pulses being scaled with respect to the peak voltages of the three or more drive pulses in the predetermined positions.

2. The method of claim 1, further comprising applying a third waveform having one or more drive pulses fired to cause the droplet ejection device to eject a third droplet of the fluid with a third droplet size in response to applying the third waveform to the actuator.

3. The method of claim 1, wherein the second multi-pulse waveform includes only one embedded drive pulse to cause the droplet ejection device to eject the second droplet of the fluid.

4. A method for driving a droplet ejection device having an actuator, comprising:

generating a first multi-pulse waveform that includes drive pulses in predetermined positions;

applying drive pulses of the first multi-pulse waveform to the actuator to cause the droplet ejection device to eject a first droplet with a first droplet size of a fluid;

generating a second multi-pulse waveform that includes no drive pulses in the predetermined positions and one or more drive pulses at locations embedded between the predetermined positions; and applying the one or more drive pulses of the second multi-pulse waveform to the actuator to cause the droplet ejection device to eject a second droplet with a second droplet size of the fluid, wherein the first and second droplets have different droplet sizes, wherein the second multi-pulse waveform has two embedded drive pulses and no drive pulses in the predetermined positions to cause the droplet ejection device to eject the second droplet of the fluid.

5. A method for driving a droplet ejection device having an actuator, comprising:

generating a first multi-pulse waveform that includes drive pulses in predetermined positions;

applying drive pulses of the first multi-pulse waveform to the actuator to cause the droplet ejection device to eject a first droplet with a first droplet size of a fluid;

generating a second multi-pulse waveform that includes no drive pulses in the predetermined positions and one or more drive pulses at locations embedded between the predetermined positions; and applying the one or more drive pulses of the second multi-pulse waveform to the actuator to cause the droplet ejection device to eject a second droplet with a second droplet size of the fluid, wherein the first and second droplets having different droplet sizes, wherein the first multi-pulse waveform has three drive pulses in their predetermined positions to cause the droplet ejection device to eject the first droplet of the fluid.

6. The method of claim 5, wherein the first droplet size is greater than the second droplet size which is greater than the third droplet size.

7. The method of claim 5, wherein a time period from initiation to termination of the first multi-pulse waveform is the same as a time period from initiation to termination of the second multi-pulse waveform.

8. The method of claim 1, wherein the effective drop velocity for each of the first and second droplets is approximately 8 m/s with a range from 6 m/s to 11 m/s.

9. The method of claim 1, wherein the droplet ejection device comprises a pumping chamber and the actuator operates to vary the pressure of the fluid in the pumping chamber in response to the drive pulses.

10. An apparatus, comprising:

an actuator to eject droplets of a fluid from a pumping chamber in response to a plurality of waveforms applied to the actuator, wherein the droplets are of different sizes; and drive electronics coupled to the actuator with the drive electronics to drive the actuator with the plurality of waveforms, wherein the drive electronics drives the actuator with:

a first multi-pulse waveform that includes three or more drive pulses in predetermined positions and no drive pulses at locations embedded between the predetermined positions to cause the actuator to eject a first droplet of the fluid, and a second multi-pulse waveform that includes no drive pulses in the predetermined positions and one or more drive pulses at locations embedded between the predetermined positions, to cause the actuator to eject a second droplet of the fluid, wherein the first and second droplets each have a different droplet size, these droplets are ejected at substantially the same effective drop velocity based on the peak voltages of the one or more drive pulses being scaled with respect to the peak voltages of the three or more drive pulses in the predetermined positions.

11. The apparatus of claim 10, wherein a third waveform has one or more drive pulses fired to cause the droplet ejection device to eject a third droplet of the fluid with a third droplet size in response to applying the third waveform to the actuator.

12. The apparatus of claim 10, wherein the second multi-pulse waveform includes only one embedded drive pulse to cause the droplet ejection device to eject the second droplet of the fluid.

13. An apparatus, comprising:

an actuator to eject droplets of a fluid from a pumping chamber in response to a plurality of waveforms applied to the actuator, wherein the droplets are of different sizes; and drive electronics coupled to the actuator with the drive electronics to drive the actuator with the plurality of waveforms, wherein the drive electronics drives the actuator with:

a first multi-pulse waveform that includes drive pulses in predetermined positions to cause the actuator to eject a first droplet of the fluid, and a second multi-pulse waveform that includes no drive pulses in the predetermined positions and one or more drive pulses at locations embedded between the predetermined positions, to cause the actuator to eject a second droplet of the fluid, wherein the first and second droplets each have a different droplet size, wherein the second multi-pulse waveform has two embedded drive pulses and no drive pulses in the predetermined positions to cause the droplet ejection device to eject the second droplet of the fluid.

14. An apparatus, comprising:

an actuator to eject droplets of a fluid from a pumping chamber in response to a plurality of waveforms applied to the actuator, wherein the droplets are of different sizes; and drive electronics coupled to the actuator with the drive electronics to drive the actuator with the plurality of waveforms, wherein the drive electronics drives the actuator with:

a first multi-pulse waveform that includes drive pulses in predetermined positions to cause the actuator to eject a first droplet of the fluid, and a second multi-pulse waveform that includes no drive pulses in the predetermined positions and one or more drive pulses at locations embedded between the predetermined positions, to cause the actuator to eject a second droplet of the fluid, wherein the first and second droplets each have a different droplet size, wherein the first multi-pulse waveform has three drive pulses in their predetermined positions to cause the droplet ejection device to eject the first droplet of the fluid.

15. The apparatus of claim 14, wherein the first droplet size is greater than the second droplet size which is greater than the third droplet size.

16. A printhead, comprising:

an ink jet module that comprises, an actuator to eject droplets of a fluid from a pumping chamber in response to a plurality of waveforms applied to the actuator, wherein the droplets are of different sizes; and drive electronics coupled to the actuator with the drive electronics to drive the actuator with the plurality of waveforms, wherein the drive electronics drives the actuator with:

a first multi-pulse waveform that includes three or more drive pulses in predetermined positions and no drive pulses at locations embedded between the predetermined positions to cause the actuator to eject a first droplet of the fluid, and a second multi-pulse waveform that includes no drive pulses in the predetermined positions and one or more drive pulses at locations embedded between the predetermined positions, to cause the actuator to eject a second droplet of the fluid, wherein the first and second droplets each have a different droplet size, these droplets are ejected at substantially the same effective drop velocity based on the peak voltages of the one or more drive pulses being scaled with respect to the peak voltages of the three or more drive pulses in the predetermined positions.

17. The printhead of claim 16, wherein a third waveform has one or more drive pulses fired to cause the droplet ejection device to eject a third droplet of the fluid with a third droplet size in response to applying the third waveform to the actuator.

18. The printhead of claim 16, wherein the second multi-pulse waveform includes only one embedded drive pulse to cause the droplet ejection device to eject the second droplet of the fluid.

19. A printhead, comprising:

an ink jet module that comprises, an actuator to eject droplets of a fluid from a pumping chamber in response to a plurality of waveforms applied to the actuator, wherein the droplets are of different sizes; and drive electronics coupled to the actuator with the drive electronics to drive the actuator with the plurality of waveforms, wherein the drive electronics drives the actuator with:

a first multi-pulse waveform that includes drive pulses in predetermined positions to cause the actuator to eject a first droplet of the fluid, and a second multi-pulse waveform that includes no drive pulses in the predetermined positions and one or more drive pulses at locations embedded between the predetermined positions, to cause the actuator to eject a second droplet of the fluid, wherein the first and second droplets each have a different droplet size, wherein the second multi-pulse waveform has two embedded drive pulses and no drive pulses in the predetermined positions to cause the droplet ejection device to eject the second droplet of the fluid.

20. The printhead of claim 16, wherein the first multi-pulse waveform has three drive pulses in their predetermined positions to cause the droplet ejection device to eject the first droplet of the fluid.

21. The printhead of claim 16, wherein the ink jet module further comprises:

a carbon body, a stiffener plate, a cavity plate, a first flex print, a nozzle plate, an ink fill passage, and a second flex print.

22. A method for driving a droplet ejection device having an actuator, comprising:

generating a first multi-pulse waveform that includes one or more drive pulses in at least one of three predetermined positions for drive pulses and one or more additional embedded pulses in at least one of two embedded positions with each embedded pulse in the embedded position being embedded between two predetermined positions; and applying the one or more drive pulses and the one or more additional embedded pulses of the first multi-pulse waveform to the actuator to cause the droplet ejection device to eject a first droplet with a first droplet size of a fluid, wherein peak voltages of the one or more embedded drive pulses are scaled with respect to peak voltages of the one or more drive pulses.

23. The method of claim 22, further comprising:

generating a second multi-pulse waveform that includes zero or more drive pulses that are in the predetermined positions and zero or more additional pulses that are each located in the second multi-pulse waveform at locations embedded between the predetermined positions; and applying drive pulses of the second multi-pulse waveform to the actuator to cause the droplet ejection device to eject a second droplet with a second droplet size of the fluid in response to the pulses of the second multi-pulse waveform.

24. The method of claim 23, further comprising applying a third waveform having one or more drive pulses fired to cause the droplet ejection device to eject a third droplet of the fluid with a third droplet size in response to applying the third waveform to the actuator.

25. The method of claim 24, wherein the first, second, and third droplets have different droplet sizes and are ejected at substantially the same effective drop velocity.

* * * * *